US006199950B1

(12) United States Patent
Noll

(10) Patent No.: US 6,199,950 B1
(45) Date of Patent: Mar. 13, 2001

(54) GLIDER SEAT WITH SLATS

(76) Inventor: Ronald C. Noll, 25 Fairway Trail, Moreland Hills, OH (US) 44022

( * ) Notice: Subject to any disclaimer, the term of this patent is extended or adjusted under 35 U.S.C. 154(b) by 0 days.

(21) Appl. No.: 09/369,136

(22) Filed: Aug. 5, 1999

(51) Int. Cl.[7] ..... A47D 13/10
(52) U.S. Cl. ..... 297/273; 297/452.63
(58) Field of Search ..... 297/281, 273, 297/258.1, 452.63, 452.18

(56) References Cited

U.S. PATENT DOCUMENTS

| | | | | |
|---|---|---|---|---|
| D. 48,329 | | 12/1915 | Severt . | |
| D. 270,500 | | 9/1983 | Harper, Jr. et al. . | |
| D. 314,677 | | 2/1991 | Hanna . | |
| D. 319,354 | | 8/1991 | Wolcott . | |
| D. 320,706 | | 10/1991 | McInerny . | |
| D. 382,721 | | 8/1997 | Jacobi . | |
| D. 400,720 | | 11/1998 | Pomeroy et al. . | |
| 1,271,453 | * | 7/1918 | Elzey | 297/281 |
| 2,710,650 | * | 6/1955 | Sowder | 297/273 |
| 3,047,334 | * | 7/1962 | Vanderminden | 297/281 |
| 3,565,487 | * | 2/1971 | Reiter | 297/452.63 |
| 3,994,468 | * | 11/1976 | Carter et al. | 297/281 X |
| 4,213,650 | * | 7/1980 | Sroub | 297/281 |
| 5,667,273 | * | 9/1997 | Noll | 297/273 X |
| 5,842,741 | * | 12/1998 | Onorini | 297/281 |

* cited by examiner

*Primary Examiner*—Peter M. Cuomo
*Assistant Examiner*—Stephen Vu
(74) *Attorney, Agent, or Firm*—Pearne & Gordon,LLP

(57) ABSTRACT

A glider includes a stationary base frame, a seat, and side frames rigidly affixed to opposite ends of the seat and each movably affixed and suspended from the base frame. The seat has a seat frame and a plurality of slats each secured to the seat frame and collectively forming an upwardly extending back portion adjoined to a generally horizontal seat portion. The slats each have a front surface with a generally planar central portion and arcuate edge portions on opposite sides of the central portion. Each of the edge portions has a width equal to at least 25% of a total width of each of the slats and has a thickness greater than 50% of a total thickness of each of the slats.

24 Claims, 4 Drawing Sheets

GLIDER SEAT WITH SLATS

BACKGROUND OF THE INVENTION

The present invention generally relates to gliders and, more specifically, to gliders having seats with slats.

Gliders, also referred to as swings, are lawn or porch furniture providing single or multiple person seating that is generally suspended so that it may rock or swing. Often the seating surface is formed by a plurality of parallel slats or panels. The slats are typically wood. While these wood slats provide a pleasing appearance, they often provide an unpleasing feeling for the person seated thereon. Particularly, when the person is sitting on the slats for an extended period of time. Accordingly, there is a need in the art for a glider seat having slats which has improved feeling or comfort for a person seated thereon while maintaining a pleasing appearance.

BRIEF SUMMARY OF THE INVENTION

The present invention provides a glider seat which overcomes the above-noted problems of the related art. According to the present invention, a glider seat includes a seat frame and a plurality of slats each secured to the seat frame and collectively forming an upwardly extending back portion adjoined to a generally horizontal seat portion. The slats each have a front surface with a generally planar central portion and arcuate edge portions on opposite sides of the central portion. Each of the edge portions have a width equal to at least 25% of a total width of each of the slats.

According to another aspect of the invention, a glider seat includes a seat frame and a plurality of slats each secured to the seat frame and collectively forming an upwardly extending back portion adjoined to a generally horizontal seat portion. The slats each have a front surface with a generally planar central portion and arcuate edge portions on opposite sides of the central portion. Each of the edge portions have a thickness greater than 50% of a total thickness of the slat.

DETAILED DESCRIPTION OF PREFERRED EMBODIMENTS

Figure 1:
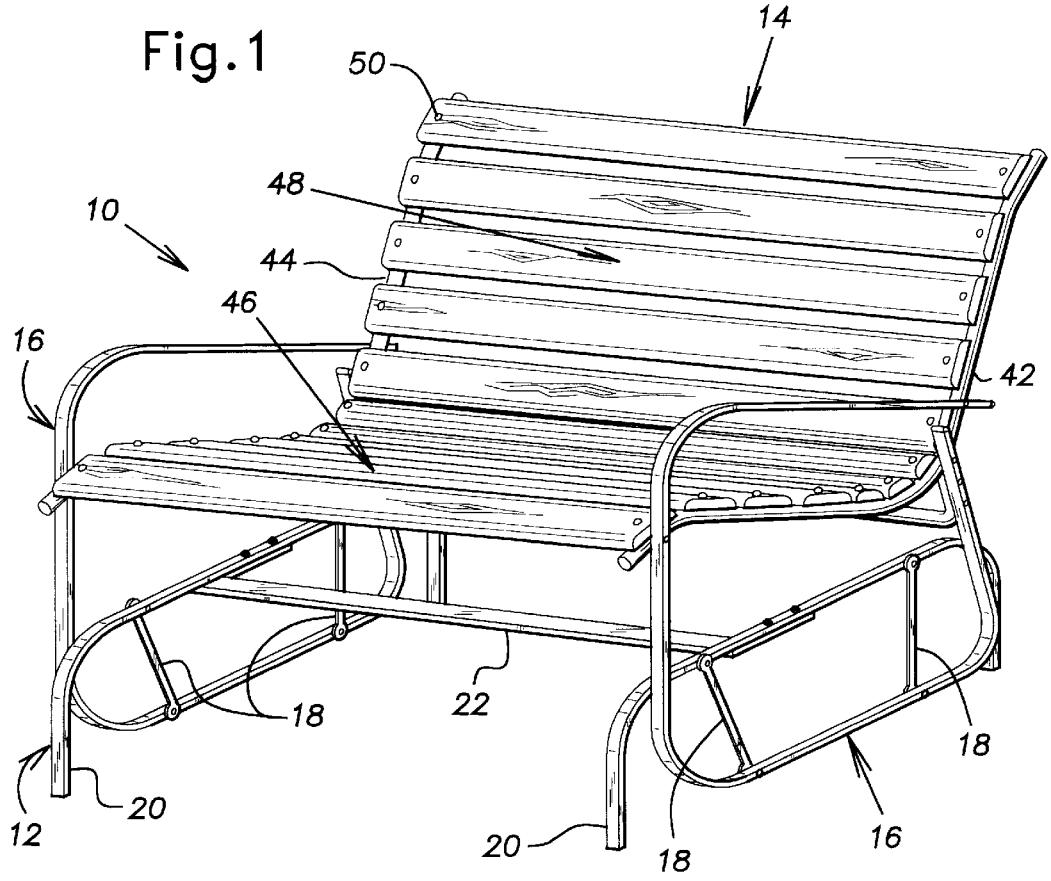
FIG. 1 is a perspective view of a glider with a slatted seat in accordance with the present invention.
Figure 2:
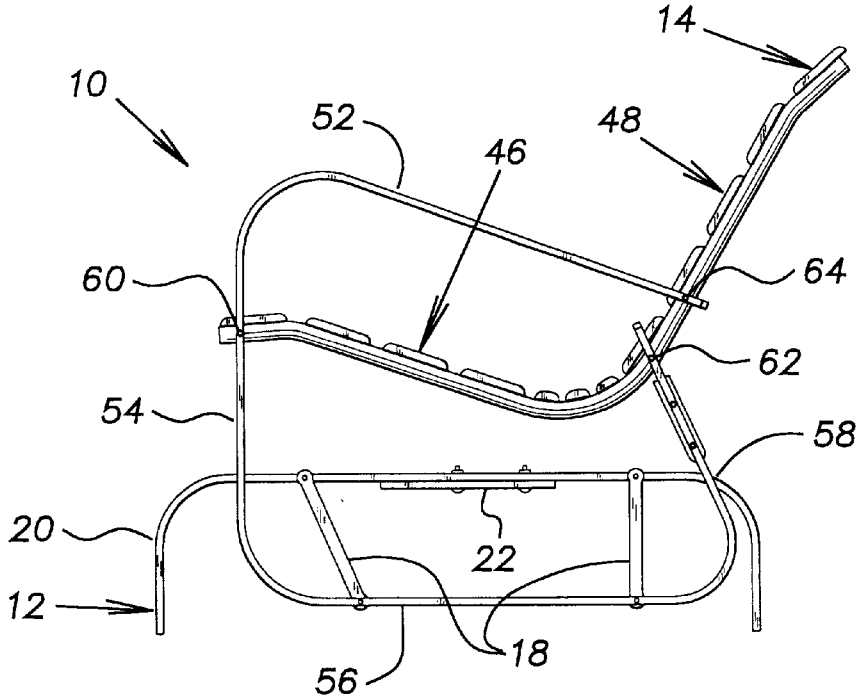
FIG. 2 is a side elevational view of the glider illustrated in FIG. 1.
Figure 3:
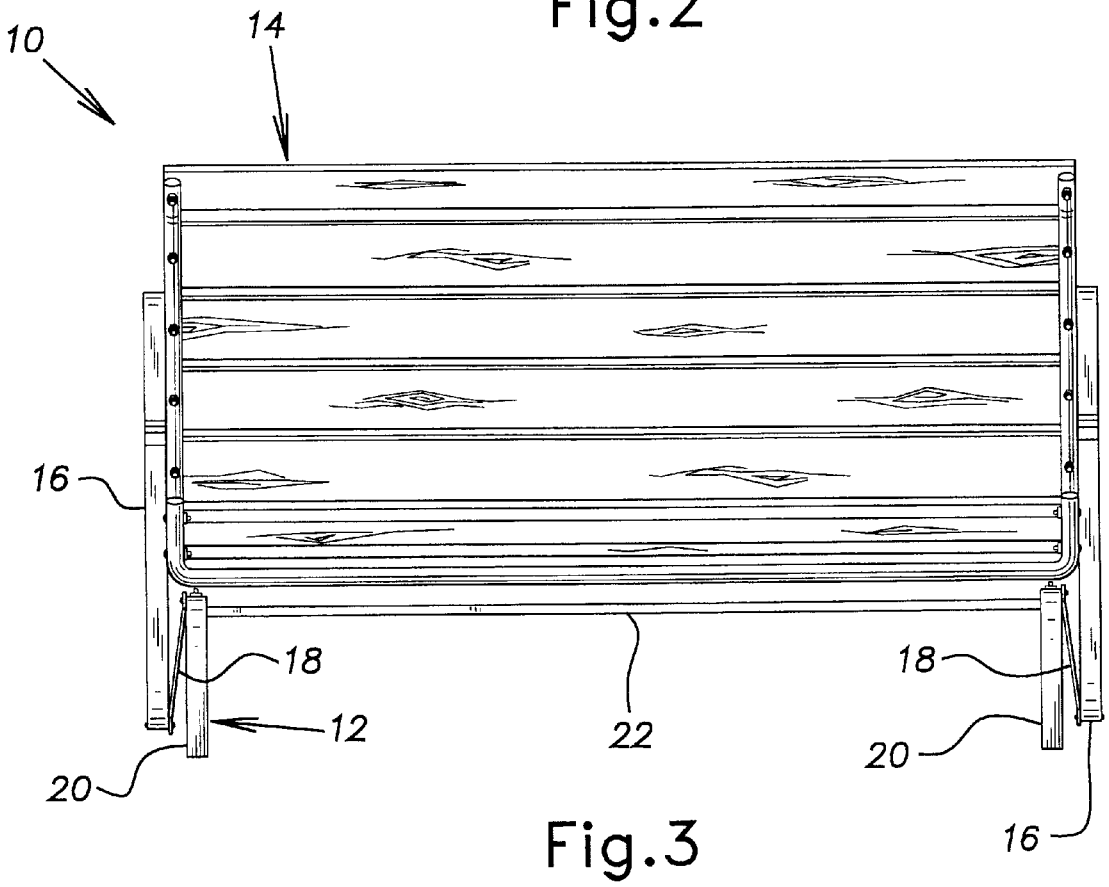
FIG. 3 is a rear elevational view of the glider illustrated in FIGS. 1 and 2.

FIGS. 1–3 illustrate a first embodiment of a glider 10 in accordance with the present invention. The illustrated glider

10 includes a stationary base frame 12, a movable seat or bench 14, first and second side frames 16 rigidly connected to opposite ends of the seat 14, and a plurality of bands 18 suspending the seat 14 and the side frames 16 from the base frame 12.

The base frame 12 includes two laterally spaced apart end members 20 and a cross member 22 extending between the end members 20. The end members 20 are preferably disposed proximately and below each end of the seat 14. The illustrated end members 20 are located laterally inward of the side frames 16 but alternatively can be located laterally outward of the side frames 16 in a known manner. The cross member 22 preferably is perpendicularly oriented to the end members 20 and rigidly connects the end members 20.

Figure 4:
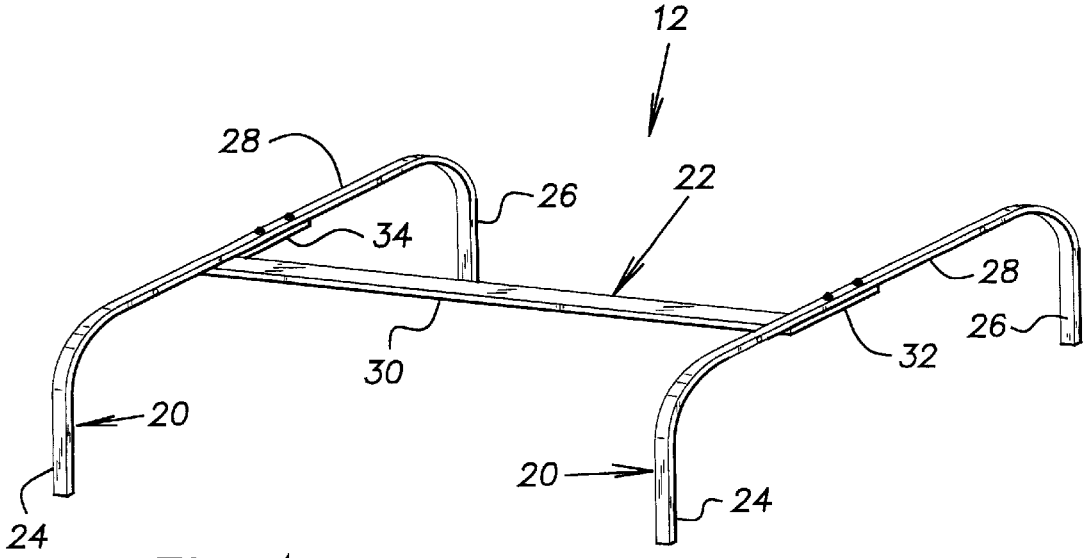
FIG. 4 is a perspective view of a base frame of the glider illustrated in FIGS. 1–3.

As best shown in FIG. 4, each illustrated end member 20 is generally shaped like an inverted "U" and has a generally vertical forward leg section 24, a generally vertical rearward leg section 26, and a generally horizontal connecting section 28 extending between the leg sections 24, 26. The illustrated cross member 22 is also generally "U-shaped" and has a main segment 30 and first and second attachment segments 32, 34 perpendicularly extending from opposite ends of the main segment 30. The end members 20 and the cross member 22 are affixed to one another to form a rigid one piece assembly. Preferably, the cross member is horizontally oriented with the attachment segments 32, 34 of the cross member 22 connected to the connecting sections 28 of the end members 20 generally at the center of the end members 20. While the illustrated cross member 22 is rearward facing, it is noted that the cross member 22 can be rearward or forward facing when horizontally oriented. It is also noted that the cross member 22 can alternatively be secured to other locations of the end members 20, such as, for example, the cross member 22 can be vertically oriented with the attachment segments 32, 34 of the cross member 22 connected to the rearward leg sections 26 of the end members 20. Affixment between the end members 20 and the cross member 22 can be accomplished by any suitable means such as, for example, welding or threaded fasteners.

The end members 20 and the cross member 22 can be made from a variety of materials, including but not limited to steel, aluminum, wood, and plastic. For the end members 20, particularly, steel tubing is generally preferred, typically in the form of from about 1" to about 1½" tubing having a gauge of about 16 to 19. The material is preferably treated or otherwise provided with a layer or coating of weather protectant material. For steel tubing, it is preferred to flowcoat or powder coat the exterior surfaces.

Figure 5:
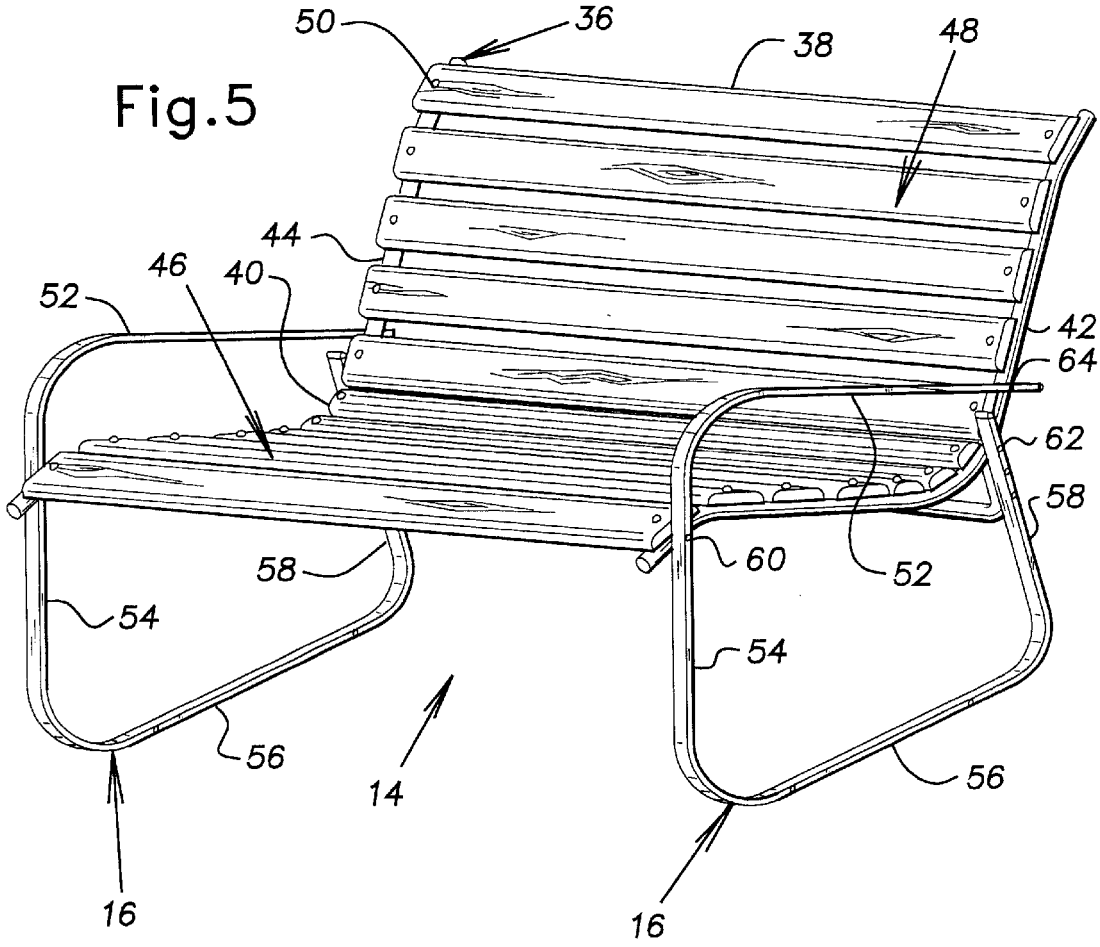
FIG. 5 is a perspective view of a bench or seat of the glider illustrated in FIGS. 1–3.

As best shown in FIG. 5, the seat 14 includes a frame 36, a plurality of spaced-apart elongate main slats or panels 38, and a plurality of spaced-apart elongate transition slats or panels 40. The seat 14 can be sized for one or more persons.

The illustrated seat frame 36 includes a pair of laterally spaced apart and separate first and second side portions 42, 44. The separate side portions 42, 44 are preferably each formed of a bent tube. It is noted that alternatively the seat frame 36 can be in the form of a single continuous bent tube rather than separate tubes. End caps are preferably provided in the open ends of the seat frame 36 when the seat frame 36 is formed from bent tubes. Alternatively, the ends of the tube can be left open or the seat frame 36 can be formed of a closed tube, i.e. its ends joined to one another.

The seat frame 36 can be made from a variety of materials, including but not limited to steel, aluminum, wood, and plastic. Steel tubing is generally preferred, typically in the form of from about 1" to about 1½" tubing having a gauge of about 16 to 19. The material is preferably treated or otherwise provided with a layer or coating of weather protectant material. For steel tubing, it is preferred to flowcoat or powder coat the exterior surfaces.

The main slats 38 laterally extend from the first side portion 42 to the second side portion 44 to form a generally horizontal seat support surface or seat portion 46 and a generally vertical back support surface or back portion 48. The transition slats 40 laterally extend from the first side portion 42 to the second side portion 44 to form a transition between the seat portion 46 and the back portion 48. The slats 38, 40 extend substantially perpendicular to the frame side portions 42, 44.

The slats 38, 40 can be formed from a wide array of materials. The materials employed should be sufficiently strong to support the weight of the users of the glider, be weather resistant or treated to be such, lightweight, and amenable to incorporation in the glider 10. A preferred class of materials for the slats 38,40 is wood. The slats 38, 40 can be affixed to the side portions 42, 44 by a variety of techniques, such as, for example, the illustrated threaded fasteners 50 extending between the slats 38, 40 and the side portions 42, 44.

As previously noted, the seat slats 38, 40 can be formed from a wide array of materials such as, for example, wood. Examples of suitable wood include but are not limited to cedar, mahogany, pine, redwood and oak. It is also contemplated that other materials may be utilized instead of or in addition to wood. Examples of such materials include plastic and fiberglass.

The first and second side frames 16 are rigidly affixed to each lateral end of the seat 14. Each side frame 16 is preferably in the form of a single continuous bent tube. End caps are preferably provided in the open ends of the side frame 16 when the side frame 16 is formed from a bent tube. Alternatively, the ends of the tube can be left open or the side frame 16 can be formed of a closed tube, i.e. its ends joined to one another. The bent tube of the side frame 16 preferably has a rectangular cross section to form a generally planar arm support surface. Alternatively, when the tubes have other cross-sectional shapes such as round, separate arm rests or supports can be rigidly affixed to the tops of the side frames 16. The arm supports are preferably flat, planar members such as a portion of the main slats 38. The separate arm supports can be affixed to the side frames 16 by a variety of techniques, such as, for example, threaded fasteners extending between the arm support and the side frame 16.

The illustrated side frame 16 has a generally horizontal upper region 52, a substantially vertical front region 54, a substantially horizontal lower region 56, and a generally vertical back region 58. The upper region 52 rearwardly extends from the top of the front region 54 and preferably slopes downward in a rearward direction, i.e. its rearward end is lower than its forward end. The front region 54 vertically extends from the forward end of the upper region 52 to the forward end of the lower region 56. The lower region 56 is substantially perpendicular to the front region 54 and extends between the bottom end of the front region 54 and the bottom end of the back region 58. The back region 58 upwardly extends from the rearward end of the lower region 56 and preferably slopes forward or inward in an upward direction, i.e. its top end is forward of its bottom end. It is noted that the side frames 16 can alternatively have many other different shapes or configurations within the scope of the present invention.

The side frames 16 can be made from a variety of materials, including but not limited to steel, aluminum, wood, and plastic. Steel tubing is generally preferred, typically in the form of from about 1" to about 1½" tubing having a gauge of about 16 to 19. The material is preferably treated or otherwise provided with a layer or coating of weather protectant material. For steel tubing, it is preferred to flowcoat or powder coat the exterior surfaces.

The seat 14 and the side frames 16 are rigidly affixed to one another and constitute the swinging or movable portion of the glider 10 as explained in greater detail hereinbelow. The side frames 16 are preferably affixed to the seat 14 by welding or threaded fasteners. It is noted, however, that other affixment techniques can be utilized instead of or in addition to welding or threaded fasteners. Each side frame is preferably affixed to the seat at three locations 60, 62, 64. The first affixment location 60 is the point of contact between the front region 54 of the side frame 16 and the side portion 42, 44 of the seat frame 36. The second affixment location 62 is the point of contact between the back region 58 of the side frame 16 and the side portion 42, 44 of the seat frame 36. The third affixment location 64 is the point of contact between the upper region 52 of the side frame 16 and the side portion 42, 44 of the seat frame 36. It is noted that there may be a greater or lesser number of affixment locations depending on the shape or configuration of the side frame 16 and/or the seat frame 36.

The rigid assembly formed by the seat 14 and the side frames 16 is movably suspended from the stationary base frame 12. As best shown in FIGS. 1–3, the seat 14 and the side frames 16 are suspended from the base frame 12 by the plurality of suspending bands 18. Preferably, one or more suspending bands 18 are affixed between the connecting section 28 of each base frame end member 20 and the lower region 56 of each side frame 16. As best shown in FIG. 3, the side frames 16 and the base frame end members 20 are approximately parallel to one another in the vertical direction and the suspending bands 18 are disposed between them. Affixment between the base frame end members 20 and the side frames 16 by the suspending bands 18 is such that the seat 14 and the side frames 16 are supported by the stationary base frame 12 and can be moved relative to the stationary base frame 12. Preferably, such affixment is achieved by a bushing and fastener assembly utilized at each point of affixment of the suspending bands 18.

The suspending bands 18 are preferably in the form of metallic straps, however, other suitable materials and other suitable configurations can be utilized. For example, although the glider 10 illustrated in FIGS. 1–3 is shown to utilize two suspending bands 18 on each side of the glider 10, a lesser or greater number can be used and/or the suspending bands 18 can be formed from an elastomeric material.

Figure 6:
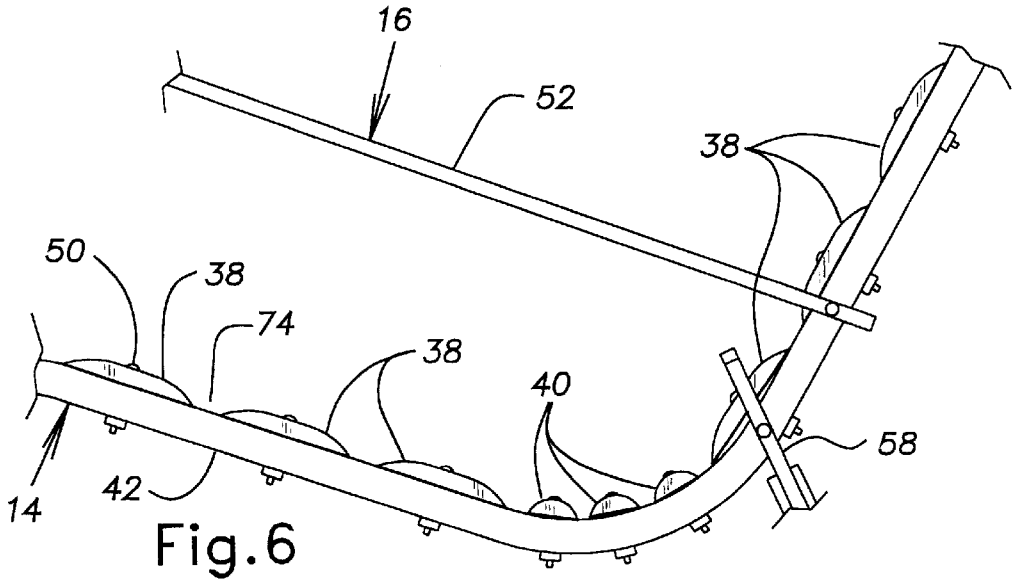
FIG. 6 is an enlarged side elevational view of a fragment of FIG. 2 showing the slats of the glider seat illustrated in FIGS. 1–3.

As best shown in FIG. 6, the main and transition slats 38, 40 are each contoured to reduce the effect of pinch points between separate spaced-apart slats 38, 40 and to give more of a feeling of a single continuous support surface. A pinch point is a minimum gap between adjacent slats which is outward facing and through which a person tends to partially extend when pressed thereagainst. This result is generally obtained by reducing the gap or spacing between adjacent slats 38, 40 to have relatively narrow pinch points, contouring the slats 38, 40 to inwardly offset the pinch points away from support surface of the seat portion 46 and the back portion 48, and/or to have transition slats 40 at the transition between the seat portion 46 and the back portion 48.

Figure 7:
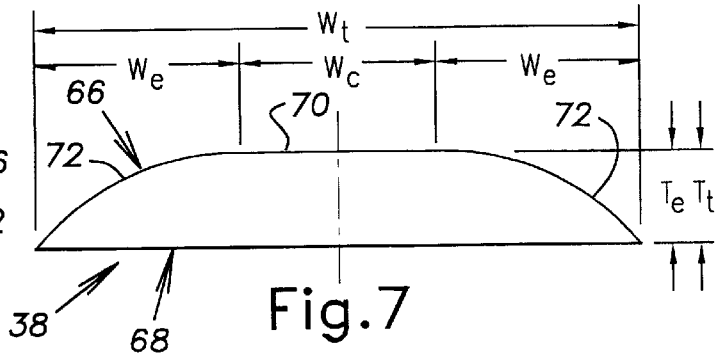
FIG. 7 is an enlarged side elevational view of a fragment of FIG. 6 showing the end of one of the main slats.

As best shown in FIG. 7, the contoured main slats 38 are each generally elongate and each have a compound front or outer surface 66 and a generally planar rear or inner surface 68. The front surface 66, which includes a generally planar central portion 70 and arcuate or curved edge portions 72 on opposite lateral sides of the central portion 70, extends the length of the main slat 38. The edge portions 72 preferably have a gentle slope and the central portion 70 preferably has a substantial width so that there remains a feeling of a continuous support surface. The edge portions 72 preferably each have a width $W_e$ equal to at least 25% of a total width $W_t$ of each of the main slats 38 and more preferably each have a width $W_e$ equal to about 33% of the total width $W_t$ of each of the main slats 38. In the illustrated embodiment, and most preferably, the edge portions 72 each have a width $W_e$ generally equal to a width $W_c$ of the central portion 70 so that each of the portions 70, 72 have a width $W_e$ equal to about 33% of the total width $W_t$ of each of the main slats 38. The central portion 70 preferably has a width $W_c$ equal to at least 25% of a total width $W_t$ of each of the main slats 38 and more preferably has a width $W_c$ equal to about 33% of the total width $W_t$ of each of the main slats 38. Each of the edge portions 72 also preferably have a width $W_e$ at least as large as a distance or gap 74 (FIG. 6) between adjacent main slats 38. It is noted that while the edge portions 72 preferably have equal widths, the edge portions 72 can have unequal widths.

The edge portions 72 preferably extend a distance great enough to substantially offset the pinch points inwardly from the central portion 70 of the main slats 38. The edge portions 72 preferably each have a thickness $T_e$ greater than 50% of a total thickness $T_t$ of each of the main slats 38, more preferably each have a thickness $T_e$ equal to or greater than about 75% of the total thickness $T_t$ of each of the main slats 38 (for example see FIG. 9), and even more preferably each have a thickness $T_e$ equal to or greater than about 88% of the total thickness $T_t$ of each of the main slats 38 (for example see FIG. 10). As best shown in FIG. 7, and most preferably, the edge portions 72 each have a thickness $T_e$ equal to the total thickness $T_t$ of each of the main slats 38, that is, equal to about 100% of the total thickness $T_t$ of each of the main slats 38.

The rear surface 68 of each main slat 38 is substantially planar and is preferably substantially parallel with the central portion 70 of the front surface 66. The rear surface 68 extends both the length of the main slats 38 and the width of the main slats 38.

Figure 8:
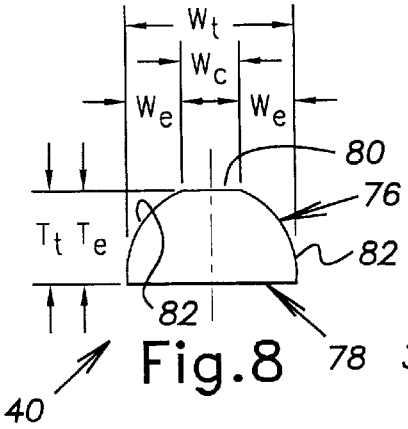
FIG. 8 is an enlarged side elevational view of a fragment of FIG. 6 showing the end of one of the transition slats.

As best shown in FIG. 8, the contoured transition slats 40 are each generally elongate and each have a compound front or outer surface 76 and a generally planar rear or inner surface 78. The transition slats 40 each have a total width $W_t$ smaller than the total width $W_t$ of each of the main slats 38.

The front surface 76, which includes a generally planar central portion 80 and arcuate or curved edge portions 82 on opposite lateral sides of the central portion 80, extends the length of the transition slat 40. The edge portions 82 preferably each have a width $W_e$ equal to at least 25% of the total width $W_t$ of each of the transition slats 40 and more preferably each have a width $W_e$ equal to about 33% of the total width $W_t$ of each of the transition slats 40. In the illustrated embodiment, and most preferably, the edge portions 82 each have a width $W_e$ generally equal to a width $W_c$ of the central portion 80 so that each of the portions 80, 82 have a width equal to about 33% of the total width $W_t$ of each of the transition slats 40. The central portion 80 preferably has a width $W_c$ equal to at least 25% of the total width $W_t$ of each of the transition slats 40 and more preferably each have a width $W_c$ equal to about 33% of the total width $W_t$ of each of the transition slats 40. It is noted that while the edge portions 82 preferably have equal widths, the edge portions 82 can have unequal widths.

The edge portions 82 preferably extend a distance great enough to substantially offset the pinch points inwardly from the central portion 80 of the transition slats 40. The edge portions 82 preferably each have a thickness $T_e$ greater than 50% of the total thickness $T_t$ of each of the transition slats 40, more preferably each have a thickness $T_e$ equal to or greater than about 75% of the total thickness $T_t$ of each of the transition slats 40, and even more preferably each have a thickness $T_e$ equal to or greater than about 88% of the total thickness $T_t$ of each of the transition slats 40. As best shown in FIG. 8, and most preferably, the edge portions 82 each have a thickness $T_e$ equal to the total thickness $T_t$ of each of the transition slats 40, that is, equal to about 100% of the total thickness $T_t$ of each of the transition slats 40.

The rear surface 78 of each transition slat 40 is substantially planar and is preferably substantially parallel with the central portion 80 of the front surface 76. The rear surface 78 extends both the length of the transition slats 40 and the width of the transition slats 40.

As best shown in FIG. 6, the transition slats 40 are utilized to obtain a better defined transition between the seat portion 46 and the back portion 48 of the seat 14. It is noted that while the illustrated embodiment utilizes three of the transition slats 40, a greater or smaller number of the transition slats 40 can be utilized within the scope of the present invention.

Figure 9:
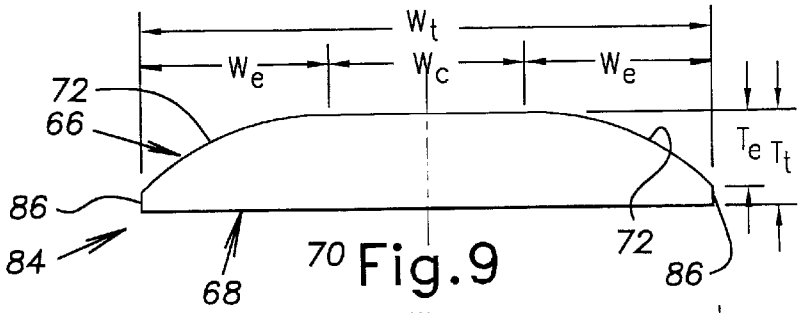
FIG. 9 is an enlarged elevational view similar to FIG. 7 but showing the end of an alternative main slat.

FIG. 9 illustrates an alternative main slat 84 wherein like reference numbers are used for like structure. The main slat 84 has opposed side surfaces 86 so that the thickness $T_e$ of the edge portions 72 is less than the total thickness $T_t$ of the main slats 38. The side surfaces 86 are substantially perpendicular to the rear surface 68 and the central portion 70 of the front surface 66.

Figure 10:
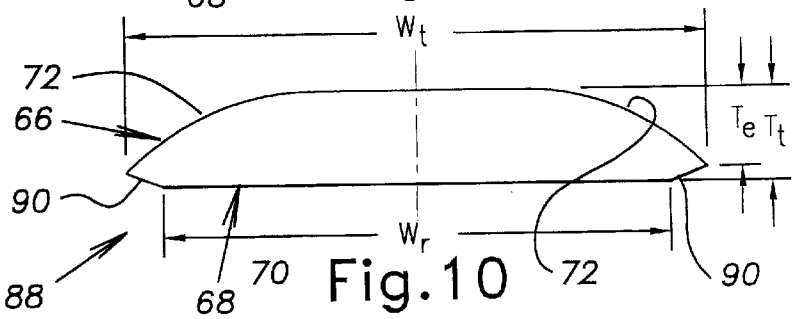
FIG. 10 is an enlarged elevational view similar to FIG. 7 but showing the end of another alternative main slat.

FIG. 10 illustrates another alternative main slat 88 wherein like reference numbers are used for like structure. The main slat 88 has side surfaces 90 so that the thickness $T_e$ of the edge portions 72 is less than the total thickness $T_t$ of the main slats 88. The side surfaces 90 are in the form of a rear relief such that the side surfaces 90 are angled inward toward the rear surface 68 and the rear surface 68 has a width $W_r$ less than the total width $W_t$ of the main slat 88 and/or the front surface 66.

Although particular embodiments of the invention have been described in detail, it will be understood that the invention is not limited correspondingly in scope, but includes all changes and modifications coming within the spirit and terms of the claims appended hereto.

What is claimed is:

1. A glider seat comprising:

a seat frame; and a plurality of slats each secured to said seat frame and collectively forming an upwardly extending back portion adjoined to a generally horizontal seat portion, said slats each having a front surface with a generally planar central portion and arcuate edge portions on opposite sides of said central portion;

wherein each of said edge portions has a width equal to at least 25% of a total width of each of said slats.

2. The glider seat according to claim 1, wherein the width of each of said edge portions is equal to at least 33% of the total width of each of said slats.

3. The glider seat according to claim 1, wherein said slats each comprise wood.

4. The glider seat according to claim 1, wherein said slats each have a generally planar rear surface.

5. The glider seat according to claim 1, wherein each of said edge portions has a width generally equal to a width of said central portion.

6. The glider seat according to claim 1, wherein each of said edge portions has a width at least as large as a distance between adjacent slats.

7. The glider seat according to claim 1, wherein said edge portions of said slats each have a thickness greater than 50% of a total thickness of each of said slats.

8. The glider seat according to claim 7, wherein the thickness of each of said edge portions is equal to the total thickness of each of said slats.

9. The glider seat according to claim 1, wherein said slats each have a rear surface with a width smaller than a width of said front surface.

10. The glider seat according to claim 1, further comprising a plurality of transition slats each secured to said seat frame and collectively forming a transition between said back portion and said seat portion, each of said transition slats having a total width smaller than the total width of each of said slats.

11. The glider seat according to claim 10, wherein said transition slats each have a front surface with a generally planar central portion and arcuate edge portions on opposite sides of said central portion.

12. A glider comprising:

a stationary base frame;

a seat having a seat frame and a plurality of slats each secured to said seat frame and collectively forming an upwardly extending back portion adjoined to a generally horizontal seat portion, said slats each having a front surface with a generally planar central portion and arcuate edge portions on opposite sides of said central portion; and side frames rigidly affixed to opposite ends of said seat, said side frames each movably affixed and suspended from said base frame;

wherein each of said edge portions has width equal to at least 25% of a total width of each of said slats.

13. A glider seat comprising:

a seat frame; and a plurality of slats each secured to said seat frame and collectively forming an upwardly extending back portion adjoined to a generally horizontal seat portion, said slats each having a front surface with a generally planar central portion and arcuate edge portions on opposite sides of said central portion, each of said edge portions having a thickness greater than 50% of a total thickness of each of said slats and each of said edge portions having a width equal to at least 25% of a total width of each of said slats.

14. The glider seat according to claim 13, wherein said slats each comprise wood.

15. The glider seat according to claim 13, wherein said slats each have a generally planar rear surface.

16. The glider seat according to claim 13, wherein each of said edge portions has a width equal to at least 33% of a total width of each of said slats.

17. The glider seat according to claim 13, wherein each of said edge portions has a width generally equal to a width of said central portion.

18. The glider seat according to claim 13, wherein each of said edge portions, has a width at least as large as a distance between adjacent slats.

19. The glider seat according to claim 13, wherein said edge portions of said slats each have a thickness equal to a total thickness of each of said slats.

20. The glider seat according to claim 13, wherein said slats each have a rear surface with a width smaller than a width of said front surface.

21. The glider seat according to claim 13, further comprising a plurality of transition slats each secured to said seat frame and collectively forming a transition between said back portion and said seat portion, each of said transition slats having a total width smaller than the total width of each of said slats.

22. The glider seat according to claim 21, wherein said transition slats each have a front surface with a generally planar central portion and arcuate edge portions on opposite sides of said central portion.

23. A glider comprising:

a stationary base frame;

a seat having a seat frame and a plurality of slats each secured to said seat frame and collectively forming an upwardly extending back portion adjoined to a generally horizontal seat portion, said slats each having a front surface with a generally planar central portion and arcuate edge portions on opposite sides of said central portion, each of said edge portions having a thickness greater than 50% of a total thickness of each of said slats; and side frames rididly affixed to opposite ends of said seat, said side frames each movably affixed and suspended from said base frame;

wherein each of said edge portions has a width equal to at least 25% of a total width of each of said slats.

24. A glider comprising a stationary base frame, a seat having a seat frame and a plurality of slats each secured to the seat frame and collectively forming an upwardly extending back portion adjacent to a generally horizontal seat portion, and a plurality of bands suspending the seat from the base frame such that the seat can move in a back and forth manner relative to the base frame, wherein the improvement comprises the slats each having a front surface with a generally planar central portion and arcuate edge portions on opposite sides of said central portion; and each of said edge portions has a width equal to at least 25% of a total width of each of said slats.

* * * * *